US005368412A

United States Patent [19]

Johnston et al.

[11] Patent Number: 5,368,412

[45] Date of Patent: Nov. 29, 1994

[54] USE OF A GELLING COMPOSITION IN WASTE TREATMENT DISPOSAL OR SOLAR PONDS

[75] Inventors: Everett L. Johnston; Ahmad Moradi-Araghi, both of Bartlesville, Okla.

[73] Assignee: Phillips Petroleum Company, Bartleville, Okla.

[21] Appl. No.: 81,877

[22] Filed: Jun. 25, 1993

Related U.S. Application Data

[62] Division of Ser. No. 904,283, Jun. 25, 1992, Pat. No. 5,259,453.

[51] Int. Cl.[5] ..... B09B 1/00

[52] U.S. Cl. ..... 405/128; 405/270; 588/250

[58] Field of Search ..... 166/292, 295; 405/128, 405/129, 258, 263, 264–268, 270; 588/249, 250; 210/734, 751

[56] References Cited

U.S. PATENT DOCUMENTS

| | | | |
|---|---|---|---|
| 3,297,088 | 1/1967 | Huitt et al. | 166/33 |
| 3,404,734 | 10/1968 | Raifsnider et al. | 166/32 |
| 3,695,356 | 10/1972 | Argabright et al. | 166/295 |
| 3,733,833 | 5/1973 | Parks et al. | 405/264 |
| 3,866,682 | 2/1975 | Jones et al. | 166/285 |
| 4,138,992 | 2/1979 | Shaffer et al. | 126/271.1 |
| 4,418,755 | 12/1983 | Sifferman | 166/281 |
| 4,452,227 | 6/1984 | Lowrey | 126/567 |
| 4,485,875 | 12/1984 | Falk | 166/295 |
| 4,584,327 | 4/1986 | Sutton | 523/130 |
| 4,643,255 | 2/1987 | Sandiford et al. | 166/295 |
| 4,703,799 | 11/1987 | Jennings, Jr. et al. | 166/276 |
| 4,860,830 | 8/1989 | Jennings, Jr. et al. | 166/312 |
| 4,928,766 | 5/1990 | Hoskin | 166/270 |
| 5,002,127 | 3/1991 | Dalrymple et al. | 166/295 |
| 5,030,036 | 6/1991 | Huff et al. | 405/266 |
| 5,067,564 | 11/1991 | Sydansk | 166/270 |
| 5,105,884 | 4/1992 | Sydansk | 166/270 |
| 5,132,021 | 7/1992 | Alexander | 210/679 |
| 5,132,023 | 7/1992 | Kozakiewicz et al. | 210/734 |
| 5,159,979 | 11/1992 | Jennings, Jr. | 166/280 |
| 5,201,608 | 4/1993 | Kugler | 405/129 |

OTHER PUBLICATIONS

Water-Soluble Polymers for Petroleum Recovery (ed. G. A. Stahl and D. N. Schulz pp. 299–312, by Moradi--Araghi et al 1988.

*Primary Examiner*—Randolph A. Reese
*Assistant Examiner*—John A. Ricci
*Attorney, Agent, or Firm*—Lucas K. Shay

[57] ABSTRACT

A process for preventing the seepage of hazardous waste material in a waste treatment pond or the loss of heat and evaporation of water in a solar pond comprises controlling the migration of a gelling composition where the density of the gelling composition is adjusted depending on the density of the residence brine of the pond so that the gelling composition gels in a desired location of the pond.

8 Claims, No Drawings

USE OF A GELLING COMPOSITION IN WASTE TREATMENT DISPOSAL OR SOLAR PONDS

This application is a division of application Ser. No. 07/904,283, filed Jun. 25, 1992, now U.S. Pat. No. 5,259,453.

FIELD OF THE INVENTION

The present invention relates to enhancing hydrocarbon production by blocking water-coning or gas-coning in oil and gas producing wells.

BACKGROUND OF THE INVENTION

A major problem associated with producing wells of oil and gas is the increased water coning. In most reservoirs, oil is produced from an oil zone which often lies over a water zone and beneath a gas zone. During production of oil from a well, water underlying the oil zone may flow strongly upward into the lower pressure zone around the well and into the well to the oil zone level. Because the water is generally lower in viscosity than oil, the water may flow more rapidly than the oil and create a water zone around the well substantially inhibiting the entry of oil into the well. This water coning is especially serious in reservoirs which is subject to a bottom water drive.

Gas-coning may also happen during oil production. This cause is a reduction in oil production resulting in an increase in gas:oil ratio. The downward flow of the lower viscosity gas into the oil zone around the production well interferes with the flow of oil into the wellbore.

Several references provide somewhat limited solutions to the above described problems. For example, U.S. Pat. No. 3,866,682 discloses controlling water and gas coning by forming a barrier having a shape like a hollow frustum in a production well. U.S. Pat. No. 3,404,734 discloses in-situ production of gels for plugging water coning. Additionally, U.S. Pat. No. 4,485,875 discloses in-situ production of gels by injecting a solution mixture of polyacrylamide, phenol and an aldehyde to selectively plug permeable zones. Moreover, U.S. Pat. No. 3,695,356 discloses a controlling mechanism by hydrolysis of gels formed by injecting water soluble, gel-forming materials. Furthermore, U.S. Pat. No. 4,418,755 discloses inhibiting water flow by injecting a gelling agent into the formation.

Finally, it is well-known that, as disclosed in Water-Soluble Polymers for Petroleum Recovery (G. A. Stahl and D. N. Schulz, editors, Plennum Press, New York, N.Y., (1988), pp. 299–312, a gelable polymer is most commonly used to divert the flow from the high permeability zones and fractures to the unswept oil-containing portions of the reservoirs. For example, in the gelation of a gelable water soluble polymer, an aldehyde is condensed with a phenolic compound along with the polymer injected into the reservoir to form gels. The gels thus formed can reduce the permeability and divert the flow of injected fluids resulting in enhanced oil recovery.

However, none of the above described references disclose the use of gellable mixtures having different buoyancies relative to the brines of the reservoirs to control the location in the reservoirs where the gels are formed. The control of such gelation would more effectively block water coning allowing the entry of oil into the well for recovery. Gelling solutions with densities lower than oil can be injected in producing wells with gas-coning problems to float on top and produce a gel at the interface to block gas coning.

SUMMARY OF THE INVENTION

It is therefore an object of the present invention to provide a process for injecting a slow gelling composition having a density higher than formation brine and a gel time longer than the time required for gravity drainage of the mixture to the base of water coning zone. It is also an object of the present invention to provide a gelling composition forming a gel that can be manipulated to rise or drain depending on its density so that it can be used as a cover for the body of water. It is another object of the present invention to provide a process for controlling the rate of gelling composition migration by density differences between gelling compositions and formation brines.

The advantage of the invention is that the cover for the body of water can further be improved by adding a foaming surfactant to the gelling composition by bubbling a suitable gas through the composition to produce a foaming gel which is useful as an evaporation barrier. Another advantage of the present invention is that dense gelling systems can be used to coat the bottom of disposal ponds to prevent seepage of hazardous materials. A further advantage of the present invention is that the gelling systems can be used in the bottom portions of producing or injection wells.

According to the present invention, a process for controlling the migration of a gelling mixture for enhanced oil recovery by blocking water or gas coning comprises injecting a gelling mixture into a subterranean formation where the density of the gelling mixture is adjusted to be higher than the density of the formation brine or lower than oil.

DETAILED DESCRIPTION OF THE INVENTION

According to the present invention, a process for controlling the migration of a gelling composition for blocking water or gas coning in a producing or injection well comprises injecting a gelable composition into the formation and the gelling composition forms a gel in the subterranean formation; wherein the density of the gelling composition is adjusted depending on the density of the formation brine.

All soluble and gellable polymers that are suitable for high salinity formation temperature (preferably acrylamide-containing polymers) or monomers which form gels in-situ upon being injected in the formation can be utilized in the present invention. It is presently preferred, however, that the polymer have a molecular weight of at least about 100,000 and more preferably 100,000 to 20,000,000. The upper limit is not critical as long as the polymer is still soluble and can be pumped into the formation. The term "soluble" used herein refers to those polymers, and monomers that are soluble or dispersible in water or a suitable medium such as oil.

The presently preferred class of acrylamide-containing polymers are those selected from the group consisting of homopolymers of acrylamide, homopolymers of methacrylamide, copolymers of acrylamide and acrylic acid, copolymers of acrylamide and potassium acrylate, copolymers of acrylamide and sodium acrylate, copolymers of acrylamide and N,N-dimethylacrylamide, copolymers of acrylamide and methacrylamide, copolymers of acrylamide and sodium 2-acrylamide-2-methylpropane sulfonate, copolymers of acrylamide and N-vinyl-2-pyrrolidone, terpolymers of acrylamide, N,N-dimethylacrylamide and 2-acrylamido-2-methylpropane sulfonate, and terpolymers of acrylamide, N-vinyl-2-pyrrolidone, and sodium 2-acrylamido-2-methypropane sulfonate. The ratio of the monomers in the above-described polymers is not critical; provided however, that at least 5 mole % of acrylamide or methacrylamide is present in the above-described polymers.

Particularly preferred are homopolymers of acrylamide, copolymers of acrylamide and sodium acrylate, copolymers of acrylamide and sodium 2-acrylamido-2-methylpropane sulfonate, copolymers of acrylamide and N-vinyl-2-pyrrolidone, and a terpolymers of N-vinyl-2-pyrrolidone, acrylamide and sodium 2-acrylamido-2-methylpropane sulfonate. However, other polymers with more subunits may also be utilized in the practice of this invention. Additionally, within the scope of this invention is the use of combinations of homopolymers, copolymers, terpolymers, and tetrapolymers utilizing the above listed monomers.

Other suitable polymers are polysaccharides such as xanthan, glucans, cellulosic materials, and mixtures thereof.

Presently preferred monomers that form gels in-situ upon being injected into the wells include, but are not limited to acrylamide, N-vinyl-2-pyrrolidone, sodium 2-acrylamido-2-methylpropane sulfonate, N,N-dimethylacrylamide, acrylic acid, alkali metal salt of acrylic acid, and mixtures thereof. Presently preferred cross-linking system include, but are not limited to phenol and formaldehyde; resorcinol and formaldehyde; furfuryl alcohol and formaldehyde; and mixtures thereof.

The polymers or monomers that form gel in-situ are generally present in the composition in the amount of from about 0.05 to about 10 weight percent, preferably from about 0.1 to about 5 weight percent, and most preferably from 0.2 to 4 weight percent. The concentration of polymer in the composition depends to some degree upon the molecular weight of the polymer. A high molecular weight results in a higher viscosity of the resulting gel for a particular concentration of polymer.

Water generally makes up the rest of the inventive composition.

An aqueous solution containing the water soluble acrylamide-containing polymer having a density higher than the formation brine density ben be pumped into the formation so that it forms gel in the formation in a desirable location of the formation so that water coning can be blocked.

The nature of the underground formation treated is not critical to the practice of the present invention. The composition of the present invention can be used in or can be injected into, fresh water, salt water, or brines, as well as at a temperature range of from about 70° F. to about 400° F., preferably from about 15020 F. to about 350° F., and most preferably from 200° F. to 300° F. However, at temperatures higher than 170° F., homopolymers are acrylamide and copolymers of acrylamide and an alkali metal salt of acrylic acid are not suitable. For temperatures lower than 170° F., homopolymers of acrylamide, copolymers of acrylamide and an alkali metal salt of acrylic acid can be used in combination with a suitable crosslinking system.

The following specific examples are intended to illustrate the advantages of this invention, but are not intended to unduly limit this invention.

EXAMPLE I

This example demonstrates that a gel can be formed in a different location in a simulated brine depending on its buoyancy, relative to the brine.

The runs were carried out by injecting ⅓ pore volume (PV) of a gelling mixture containing 5.7% Pfizer Oil Field Products "FLOPERM 325" (prepared by mixing 10.0 g "FLOPERM 325" R (a resorcinol solution), 6.76 g of Floperm 325 F (formaldehyde solution), 3.75 g of "FLOPERM 325" S-II (a salt mixture of aqueous sodium chloride/potassium chloride in 10/1 ratio) and 79.49 g of water. The pH of this solution was adjusted to 9.0 by "FLOPERM 325" C (a sodium hydroxide solution) before injection into a horizontal sandpack containing brines with different densities as shown in Table I below. The injection was made through a horizontal injection port located on the side of the sandpack at a point near the middle.

TABLE I

| Run No. | Residence Brine Used | Density (g/ml) Gel | Density (g/ml) Residence Brine | Density Diff. (g/ml) Gel-Res. Brine | Permeability to Water (Darcy) Before | Permeability to Water (Darcy) After |
|---|---|---|---|---|---|---|
| 1 | distilled water | 1.0180 | 0.9972 | +0.0208 | 8.84 | NM[a] |
| 2 | 10% EVGSAU[b] brine + 90% $H_2O$ | 1.0180 | 1.0164 | +0.0016 | 8.61 | 7.79 |
| 3 | 100% EVGSAU brine | 1.0180 | 1.1608 | −0.1428 | 6.31 | 5.75 |
| 4[c] | distilled water | 1.0180 | 0.9972 | +0.0208 | 6.64 | 6.48 |

[a]NM = Not measured.
[b]EVGSAU = East Vacuum Grayburg San Andres Unit. This brine contains 12.6% total dissolved solids.
[c]Test 4 was performed with 100-mesh glass beads. All others were done with 20–30 mesh Ottawa sand.

In runs 1, 2 and 4, gels were formed in the bottom of the sandpack. In run 3, however, the lower density gelling solution floated to the top and produced a layer of gel.

The above results indicate that the gel can be manipulated to rise up or drain depending on its density. Should there be a case where upper zone needs isolation a low density gel can be used. In the case of gas coning into oil zone, a gelling mixture in a light hydrocarbon solvent could be injected. Because of its lower density, the gelling mixture should float on the top of oil and block gas coning once set into a gel. The rate of gelling mixture migration can be controlled by the density difference.

EXAMPLE II

In one run (run 5, Table II), ⅓ PV of a gelling mixture of 2% low molecular weight polyacrylamide (Allied Colloids DP9-3976) in synthetic seawater with 500 ppm $Na_2Cr_2O_7 \cdot 2H_2O$ and 2,500 ppm $Na_2S_2O_3 \cdot 5H_2O$, was injected from the top of a vertical sandpack which contained a 20–30 mesh Ottawa sand and had been flooded with Bartlesville, Okla. tap water. The synthetic seawater contained the following:

| | |
|---|---|
| $NaHCO_3$ | 3.69 g |
| $Na_2SO_4$ | 77.19 g |
| NaCl | 429.00 g |
| $CaCl_2.2H_2O$ | 29.58 g |
| $MgCl_2.2H_2O$ | 193.92 g |
| distilled $H_2O$ | bring to 1.0 l |

The sandpack which was at room temperature was shut in for gelation. Because of the higher density (1.0235 g/mL vs. 1.0 g/mL), the gelling mixture moved to the bottom of the 30.5 cm pack and formed a gel about 14.8% of total volume of the pack. The lower volume (14.8% vs. 33.3%) of the gel might be due to dilution with water in counter current flow. This would not be a problem in an actual well treatment which would allow the residence brine to move up around the sinking gelling mixture.

Three similar runs (6–8) were performed in glass beads packs flooded with Bartlesville, Okla. tap water. The gelling mixtures were 5.7% Pfizer "FLOPERM 325" in Bartlesville tap water with a density of 1.018 g/mL. The results are summarized in the following Table II.

TABLE II

| Run No. | Packing Material | Ave. Perm (Darcy) | Delay Time (Days) | Location of Gel |
|---|---|---|---|---|
| 5 | Ottawa Sand, 20–30 mesh | 56.8 | 12 | 14.8% volume in the bottom |
| 6 | Glass Beads, 40–50 mesh | 26.6 | 22 | 6.6% volume in the bottom |
| 7[a] | Glass Beads, 40–50 mesh | 17.0 | 10 | 16.7% volume in the bottom |
| 8[a] | Smaller glass beads | 6.6 | 10 | mostly on top[b] |

[a]A by-pass line from the bottom to the top of pack avoided counter current formation.
[b]The gel time was too short for the slow moving mixture to sink down before setting.

The data in run 8 indicate that for a given reservoir, the gel time should be long enough to allow the gelling mixture to move to the desired location before setting.

These examples describe a gel placement strategy which is beneficial in many oil field operation. The gel density is manipulated to be lower or higher than the residence fluids for placing the gel in a desired location. For example, if the object is to block water coning in subterranean formations, it would be better to use a slow gelling mixture with a density higher than the residence brine. This will allow the gelling mixture to sink into the bottom of the cone and blocking a larger area for a given gel volume than a gelling mixture with the same density as the residence brine which would block a smaller area for the same volume. Another application of the higher density gel can include blocking of the bottom portions of injection or producing wells. Yet another application for the higher density gels can include the treatment of disposal ponds containing hazardous waste materials to prevent the seepage of these hazardous materials.

Since the gelling system with a density lower than water will float on top (run 3, Table I), these systems can be used to make a gel cover for a body of water. One can include a foaming surfactant in the lighter gelling compositions to produce floating foam gels which can be used as an insulator against the at loss for a body of water, such as in a solar bond.

Gelling solutions with densities lower than oil can be injected into a gas coning well. These solutions should float on the top of oil and set into a gel blocking the gas from flowing into the oil zone.

The results shown in the above examples clearly demonstrate that the present invention is well adapted to carry out the objects and attain the ends and advantages mentioned as well as those inherent therein. While modifications may be made by those skilled in the art, such modifications are encompassed within the spirit of the present invention as defined by the specification and the claims.

That which is claimed is:

1. A process for preventing the seepage of hazardous waste materials in a waste treatment pond containing residence brine comprising applying a gelling composition in said pond wherein said gelling composition has a density higher than the density of the residence brine of said pond and gels in-situ in said pond.

2. A process according to claim 1 wherein said gelling composition comprises a water-soluble acrylamide-containing polymer suitable for high salinity formations.

3. A process according to claim 2 wherein said acrylamide-containing polymer is polyacrylamide.

4. A process according to claim 2 wherein said acrylamide-containing polymer is a copolymer of acrylamide and N-vinyl-2-pyrrolidone.

5. A process according to claim 2 wherein said acrylamide-containing polymer is a copolymer of acrylamide and sodium 2-acrylamido-2-methylpropane sulfonate.

6. A process according to claim 2 wherein said acrylamide-containing polymer is a terpolymer of acrylamide, N-vinyl-2-pyrrolidone, and sodium 2-acrylamido-2-methylpropane sulfonate.

7. A process according to claim 1 wherein said gelling composition comprises a crosslinking system selected from the group consisting of phenol-formaldehyde, resorcinol-formaldehyde, furfuryl alcohol-formaldehyde, and mixtures thereof.

8. A process according to claim 7 wherein said crosslinking system is resorcinol-formaldehyde.

* * * * *